US011147430B2

(12) United States Patent
Wilson et al.

(10) Patent No.: US 11,147,430 B2
(45) Date of Patent: Oct. 19, 2021

(54) DISHWASHER INCLUDING RACK CORNER SPRAYERS

(71) Applicant: Midea Group Co., Ltd., Foshan (CN)

(72) Inventors: Mark W. Wilson, Simpsonville, KY (US); Robert M. Digman, Goshen, KY (US); Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 206 days.

(21) Appl. No.: 16/366,512

(22) Filed: Mar. 27, 2019

(65) Prior Publication Data

US 2020/0305680 A1 Oct. 1, 2020

(51) Int. Cl.

| | |
|---|---|
| ***A47L 15/16*** | (2006.01) |
| ***A47L 15/50*** | (2006.01) |
| ***A47L 15/42*** | (2006.01) |
| ***A47L 15/20*** | (2006.01) |
| ***B08B 3/02*** | (2006.01) |
| ***A47L 15/22*** | (2006.01) |
| ***A47L 15/00*** | (2006.01) |

(52) U.S. Cl.

CPC ..... *A47L 15/20* (2013.01); *A47L 15/0005* (2013.01); *A47L 15/0007* (2013.01); *A47L 15/22* (2013.01); *A47L 15/4221* (2013.01); *A47L 15/4282* (2013.01); *A47L 15/50* (2013.01); *B08B 3/02* (2013.01); *B08B 2203/02* (2013.01)

(58) Field of Classification Search

CPC ..... A47L 15/16; A47L 15/508

See application file for complete search history.

(56) References Cited

U.S. PATENT DOCUMENTS

| | | | |
|---|---|---|---|
| 1,897,821 | A | 2/1933 | Poli |
| 2,012,178 | A | 8/1935 | Anderson |
| 2,218,869 | A | 10/1940 | Bilde |
| 2,596,693 | A | 5/1952 | Karlstrom |
| 2,664,904 | A | 1/1954 | Stokes et al. |
| 2,896,642 | A | 7/1959 | Lilly |
| 3,095,885 | A | 7/1963 | Hertell et al. |
| 3,116,881 | A | 1/1964 | Dannenmann et al. |
| 3,118,458 | A | 1/1964 | Dannenmann et al. |

(Continued)

FOREIGN PATENT DOCUMENTS

| | | | |
|---|---|---|---|
| CN | 104887160 | A | 9/2015 |
| CN | 106377211 | A | 2/2017 |

(Continued)

OTHER PUBLICATIONS

Drawings and Machine English Translation of Description of CN 206950137 U (Haitao et al.) (Year: 2018).*

(Continued)

*Primary Examiner* — Irina Graf

(74) *Attorney, Agent, or Firm* — Middleton Reutlinger

(57) ABSTRACT

A dishwasher utilizes multiple rack-mounted corner sprayers disposed in corners defined between a side wall and front and rear walls of a dishwasher rack to direct fluid inwardly from the corners to wash utensils supported by the rack. The corner sprayers are in fluid communication with one another by a fluid channel that extends along the side wall of the rack, and an inlet port coupled to the first corner sprayer conveys fluid to each of the corner sprayers.

20 Claims, 5 Drawing Sheets

(56) References Cited

U.S. PATENT DOCUMENTS

| | | | |
|---|---|---|---|
| 3,288,155 | A | 11/1966 | Swetnam |
| 3,319,640 | A | 5/1967 | Flame |
| 3,468,486 | A | 9/1969 | Mercer |
| 3,496,949 | A | 2/1970 | Mercer |
| 3,708,120 | A | 1/1973 | Camprubi et al. |
| 3,718,149 | A | 2/1973 | Mazza |
| 3,727,622 | A | 4/1973 | Jacobs |
| 3,779,258 | A | 12/1973 | Brenner et al. |
| 3,890,987 | A | 6/1975 | Marcussen et al. |
| 3,903,911 | A | 9/1975 | Guth |
| 3,915,182 | A | 10/1975 | Payne |
| 3,941,139 | A | 3/1976 | Spiegel |
| 3,978,875 | A | 9/1976 | Slany |
| 4,784,168 | A | 11/1988 | Erminio |
| 5,131,419 | A | 7/1992 | Roberts |
| 5,331,986 | A | 7/1994 | Lim et al. |
| 5,655,740 | A | 8/1997 | Lazarus |
| 5,697,392 | A | 12/1997 | Johnson et al. |
| 5,816,273 | A | 10/1998 | Milocco et al. |
| 5,882,739 | A | 3/1999 | Kobos et al. |
| 5,964,232 | A | 10/1999 | Chung |
| 6,003,529 | A | 12/1999 | Perry, Jr. |
| 6,325,083 | B1 | 12/2001 | Wöerter |
| 6,601,593 | B2 | 8/2003 | Deiss et al. |
| 6,659,114 | B2 | 12/2003 | Bigott |
| 6,869,029 | B2 | 3/2005 | Ochoa, Sr. et al. |
| 6,976,496 | B2 | 12/2005 | Cantrell et al. |
| 7,021,321 | B2 | 4/2006 | Bigott |
| 7,047,986 | B2 | 5/2006 | Hausgeraete |
| 7,100,623 | B2 | 9/2006 | Assmann et al. |
| 7,137,397 | B2 | 11/2006 | Rosenbauer et al. |
| 7,231,929 | B2 | 6/2007 | Landsiedel et al. |
| 7,270,132 | B2 | 9/2007 | Inui et al. |
| 7,331,356 | B2 | 2/2008 | VanderRoest et al. |
| 7,426,933 | B2 | 9/2008 | Palm et al. |
| 7,445,013 | B2 | 11/2008 | VanderRoest et al. |
| 7,475,696 | B2 | 1/2009 | VanderRoest et al. |
| 7,478,642 | B2 | 1/2009 | Koch et al. |
| 7,523,757 | B2 | 4/2009 | Cantrell et al. |
| 7,523,758 | B2 | 4/2009 | VanderRoest et al. |
| 7,594,513 | B2 | 9/2009 | VanderRoest et al. |
| 7,754,024 | B2 | 7/2010 | Koch et al. |
| 7,754,026 | B2 | 7/2010 | Kehl |
| 7,794,550 | B2 | 9/2010 | Roth |
| 7,887,642 | B2 | 2/2011 | Jerg et al. |
| 7,896,977 | B2 | 3/2011 | Gillum et al. |
| 7,909,046 | B2 | 3/2011 | Kim et al. |
| 7,914,625 | B2 | 3/2011 | Bertsch et al. |
| 7,935,194 | B2 | 5/2011 | Rolek |
| 7,947,132 | B2 | 5/2011 | VanderRoest et al. |
| 7,959,744 | B2 | 6/2011 | Sundaram et al. |
| 7,980,260 | B2 | 7/2011 | Bertsch et al. |
| 7,988,791 | B2 | 8/2011 | Delgado |
| 8,007,598 | B2 | 8/2011 | Chen et al. |
| 8,113,222 | B2 | 2/2012 | Bertsch et al. |
| 8,137,479 | B2 | 3/2012 | VanderRoest et al. |
| 8,161,995 | B2 | 4/2012 | Armstrong et al. |
| 8,187,390 | B2 | 5/2012 | VanderRoest et al. |
| 8,211,243 | B2 | 7/2012 | Delgado |
| 8,347,898 | B2 | 1/2013 | Fountain et al. |
| 8,349,089 | B2 | 1/2013 | Bertsch et al. |
| 8,454,762 | B2 | 6/2013 | VanderRoest et al. |
| 8,454,763 | B2 | 6/2013 | VanderRoest et al. |
| 8,485,205 | B2 | 7/2013 | Fountain et al. |
| 8,522,810 | B2 | 9/2013 | Armstrong et al. |
| 8,627,678 | B2 | 1/2014 | Choi |
| 8,721,804 | B2 | 5/2014 | Beshears, Jr. et al. |
| 8,734,591 | B2 | 5/2014 | Beshears, Jr. et al. |
| 8,753,454 | B2 | 6/2014 | VanderRoest et al. |
| 8,764,908 | B2 | 7/2014 | VanderRoest et al. |
| 8,778,094 | B2 | 7/2014 | Blanchard et al. |
| 8,454,763 | C1 | 8/2014 | VanderRoest et al. |
| 8,801,863 | B2 | 8/2014 | Blanchard et al. |
| 8,801,868 | B2 | 8/2014 | Carlson et al. |
| 8,808,467 | B2 | 8/2014 | VanderRoest et al. |
| 8,834,648 | B2 | 9/2014 | Fountain |
| 8,852,351 | B2 | 10/2014 | Tuller |
| 8,871,031 | B2 | 10/2014 | Carlson et al. |
| 8,932,411 | B2 | 1/2015 | Beaudet et al. |
| 8,967,165 | B2 | 3/2015 | Buddharaju et al. |
| 9,034,109 | B2 | 5/2015 | Tuller |
| 9,034,112 | B2 | 5/2015 | Tuller et al. |
| 9,034,114 | B2 | 5/2015 | Bertsch et al. |
| 9,044,134 | B2 | 6/2015 | Park et al. |
| 9,113,766 | B2 | 8/2015 | Tuller et al. |
| 9,119,517 | B2 | 9/2015 | Carlson et al. |
| 9,119,523 | B2 | 9/2015 | McDaniel et al. |
| 9,155,447 | B2 | 10/2015 | Baldwin et al. |
| 9,161,674 | B2 | 10/2015 | Garnett |
| 9,161,677 | B2 | 10/2015 | Hofpeter et al. |
| 9,228,663 | B2 | 1/2016 | Brignone et al. |
| 9,241,607 | B2 | 1/2016 | Porcaro, II et al. |
| 9,259,138 | B2 | 2/2016 | Chen et al. |
| 9,301,670 | B2 | 4/2016 | Dalsing et al. |
| 9,474,430 | B2 | 10/2016 | Shoemaker et al. |
| 9,474,434 | B2 | 10/2016 | Carlson et al. |
| 9,615,720 | B2 | 4/2017 | Carlson et al. |
| 9,668,635 | B2 | 6/2017 | Blanchard et al. |
| 9,801,552 | B2 | 10/2017 | Romesburg |
| 10,238,266 | B2 | 3/2019 | Carlson et al. |
| 10,349,805 | B2 | 7/2019 | Blanchard et al. |
| 2005/0011544 | A1 | 1/2005 | Rosenbauer et al. |
| 2005/0022847 | A1 | 2/2005 | Nito et al. |
| 2007/0056613 | A1 | 3/2007 | Haas et al. |
| 2009/0159103 | A1 | 6/2009 | Gillum et al. |
| 2010/0043826 | A1 | 2/2010 | Bertsch et al. |
| 2010/0051069 | A1 | 3/2010 | Schessl et al. |
| 2011/0139199 | A1 | 6/2011 | Pyo et al. |
| 2011/0155184 | A1 | 6/2011 | Kim et al. |
| 2011/0155185 | A1 | 6/2011 | Kim et al. |
| 2012/0222711 | A1 | 9/2012 | Forst et al. |
| 2013/0112225 | A1 | 5/2013 | Im et al. |
| 2013/0186434 | A1 | 7/2013 | Ghosh et al. |
| 2013/0228202 | A1 | 9/2013 | Welch et al. |
| 2013/0269736 | A1 | 10/2013 | Baldwin et al. |
| 2014/0069470 | A1 | 3/2014 | Baldwin et al. |
| 2014/0069473 | A1 | 3/2014 | Baldwin et al. |
| 2014/0130833 | A1 | 5/2014 | Ryu et al. |
| 2014/0137909 | A1 | 5/2014 | Baldwin et al. |
| 2014/0137911 | A1 | 5/2014 | Baldwin et al. |
| 2014/0150827 | A1 | 6/2014 | Martineau et al. |
| 2014/0190534 | A1 | 7/2014 | Boyer |
| 2014/0261560 | A1 | 9/2014 | Mealman |
| 2014/0261584 | A1 | 9/2014 | Shoemaker et al. |
| 2014/0283880 | A1 | 9/2014 | Kim et al. |
| 2014/0352743 | A1 | 12/2014 | Fountain |
| 2014/0373876 | A1 | 12/2014 | Feddema |
| 2015/0007861 | A1 | 1/2015 | Azmi et al. |
| 2015/0028733 | A1 | 1/2015 | Patil et al. |
| 2015/0164299 | A1 | 6/2015 | Naik |
| 2015/0182095 | A1 | 7/2015 | Lee et al. |
| 2015/0201823 | A1 | 7/2015 | Poojary et al. |
| 2015/0208899 | A1 | 7/2015 | Lee et al. |
| 2015/0223665 | A1 | 8/2015 | Bertsch et al. |
| 2015/0265133 | A1 | 9/2015 | Choi et al. |
| 2015/0272421 | A1 | 10/2015 | Benedict et al. |
| 2015/0305593 | A1 | 10/2015 | Dabade et al. |
| 2015/0327747 | A1 | 11/2015 | Carlson et al. |
| 2015/0359410 | A1 | 12/2015 | Chapman et al. |
| 2015/0374203 | A1 | 12/2015 | Hirsh et al. |
| 2016/0073851 | A1 | 3/2016 | Thiyagarajan et al. |
| 2016/0278608 | A1 | 9/2016 | Edenius et al. |

FOREIGN PATENT DOCUMENTS

| | | | |
|---|---|---|---|
| CN | 107126172 | A | 9/2017 |
| CN | 206950137 | U | 2/2018 |
| CN | 107997717 | A | 5/2018 |
| DE | 7417444 | | 10/1974 |
| DE | 2911005 | A1 | 9/1980 |
| DE | 10 2008 025 207 | A1 | 12/2009 |
| EP | 795292 | A2 | 9/1997 |
| EP | 1040787 | A1 | 10/2000 |
| EP | 2708178 | B1 | 3/2015 |

(56) References Cited

FOREIGN PATENT DOCUMENTS

| | | | |
|---|---|---|---|
| JP | H1176127 | A | 3/1999 |
| KR | 20040006218 | A | 1/2004 |
| WO | 00/22973 | A1 | 4/2000 |
| WO | 2010021448 | A1 | 2/2010 |
| WO | 2015090433 | A1 | 6/2015 |
| WO | 2015185076 | A1 | 12/2015 |
| WO | 2016088011 | A1 | 6/2016 |

OTHER PUBLICATIONS

International Search Report and Written Opinion of application PCT/CN2019/093742, dated Jan. 6, 2020.

* cited by examiner

DISHWASHER INCLUDING RACK CORNER SPRAYERS

BACKGROUND

Dishwashers are used in many single-family and multi-family residential applications to clean dishes, silverware, cutlery, cups, glasses, pots, pans, etc. (collectively referred to herein as "utensils"). Due to the wide variety of items that may need to be cleaned by a dishwasher, many dishwashers provide various containers and/or specialized sprayers to address different washing needs. Many dishwashers, for example, include multiple sliding racks including arrangements of tines that can be used to separate and orient dishes, bowls, glasses, etc. to receive directed sprays of fluid from one or more rotating wash arms. In addition, many dishwashers include removable silverware baskets that may be positioned in dedicated locations on racks, and in some dishwashers, directed sprays are provided to provide deeper cleaning. Other dishwashers include dedicated high pressure spray zones to direct additional spraying power at particularly soiled items. Despite these various dedicated washing features, however, conventional dishwashers still lack flexibility in terms of addressing different consumer washing needs.

SUMMARY

The herein-described embodiments address these and other problems associated with the art by providing a dishwasher that utilizes multiple rack-mounted corner sprayers disposed in corners defined between a side wall and front and rear walls of a dishwasher rack to direct fluid inwardly from the corners to wash utensils supported by the rack. The corner sprayers are in fluid communication with one another by a fluid channel that extends along the side wall of the rack, and an inlet port coupled to the first corner sprayer conveys fluid to each of the corner sprayers.

Therefore, consistent with one aspect of the invention, a dishwasher may include a wash tub, a rack disposed in the wash tub and configured to support a plurality of utensils to be washed, the rack including a bottom, a rear wall, a front wall, a first side wall and a second side wall, a pump configured to recirculate fluid within the wash tub, a first corner sprayer disposed in a first corner of the rack defined by the rear wall and the first side wall, the first corner sprayer including at least one nozzle configured to direct a spray of fluid inwardly from each of the rear wall and the first side wall, a second corner sprayer disposed in a second corner of the rack defined by the front wall and the first side wall, the second corner sprayer including at least one nozzle configured to direct a spray of fluid inwardly from each of the front wall and the first side wall, a fluid channel extending along the first side wall of the rack and in fluid communication with each of the first and second corner sprayers, and an inlet port coupled to the first corner sprayer and in fluid communication with the fluid channel and the at least one nozzle of the first corner sprayer.

In some embodiments, the fluid channel is positioned to extend along a top of the first side wall of the rack, and the first and second corner sprayers are positioned to extend downwardly from the fluid channel towards the bottom of the rack. Also, in some embodiments, the inlet port is disposed proximate a bottom of the first corner sprayer. Further, in some embodiments, the first corner sprayer includes a generally vertical conduit extending between the inlet port and the fluid channel. In some embodiments, the first corner sprayer further includes a divider through which the generally vertical conduit projects. In addition, in some embodiments, the first and second corner sprayers, the fluid channel and the inlet port are formed of a unitary plastic body.

Some embodiments may also include a supply conduit having an outlet port coupled to the inlet port and having a major longitudinal axis extending generally transverse to the first side wall. In some embodiments, the supply conduit further includes an inlet port extending generally transverse to the major longitudinal axis of the supply conduit and configured to dock with a docking port disposed on a rear wall of the wash tub. In addition, in some embodiments, the supply conduit includes at least one tab configured to secure the supply conduit to the rack.

Moreover, in some embodiments, the rack includes a plurality of coated wires, each of the first and second corner sprayers includes at least one tab configured to engage a coated wire of the rack, and the first and second corner sprayers are removable from the rack. In some embodiments, the fluid channel includes a downwardly-facing lip disposed on an outer edge thereof to support the fluid channel on a top coated wire of the first side wall.

Moreover, in some embodiments, each of the first and second corner sprayers includes a face that extends about 45 degrees from the first side wall, and the at least one nozzle of each of the first and second corner sprayers is disposed on the face of the respective first or second corner sprayer. In some embodiments, the nozzle of at least one of the first and second corner sprayers is repositionable to control a direction of the spray of fluid.

In addition, in some embodiments, the first side wall is a left wall of the rack. Some embodiments may also include a cover extending along a top side of the fluid channel. Moreover, in some embodiments, the fluid channel is formed of plastic and the cover is formed of metal.

In addition, some embodiments may further include a spray arm disposed below the rack and configured to direct fluid upwardly into the rack, and a diverter in fluid communication between a fluid supply, the spray arm and the inlet port. In some embodiments, the diverter is configured to convey fluid concurrently from the fluid supply to the spray arm and the inlet port. In addition, in some embodiments, the diverter is configured to convey fluid separately from the fluid supply to the spray arm and the inlet port.

Consistent with another aspect of the invention, a dishwasher rack may include a bottom, a rear wall, a front wall, a first side wall and a second side wall, and a corner spray assembly including a unitary body defining a first corner sprayer, a second corner sprayer, a fluid channel and an inlet port. The first corner sprayer is disposed in a first corner of the rack defined by the rear wall and the first side wall and includes at least one nozzle configured to direct a spray of fluid inwardly from each of the rear wall and the first side wall, the second corner sprayer is disposed in a second corner of the rack defined by the front wall and the first side wall and includes at least one nozzle configured to direct a spray of fluid inwardly from each of the front wall and the first side wall, the fluid channel extends along a top of the first side wall of the rack and is in fluid communication with each of the first and second corner sprayers, the first and second corner sprayers extend downwardly from the fluid channel towards the bottom of the dishwasher rack, and the inlet port is coupled to the first corner sprayer and is in fluid communication with the fluid channel and the at least one nozzle of the first corner sprayer.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
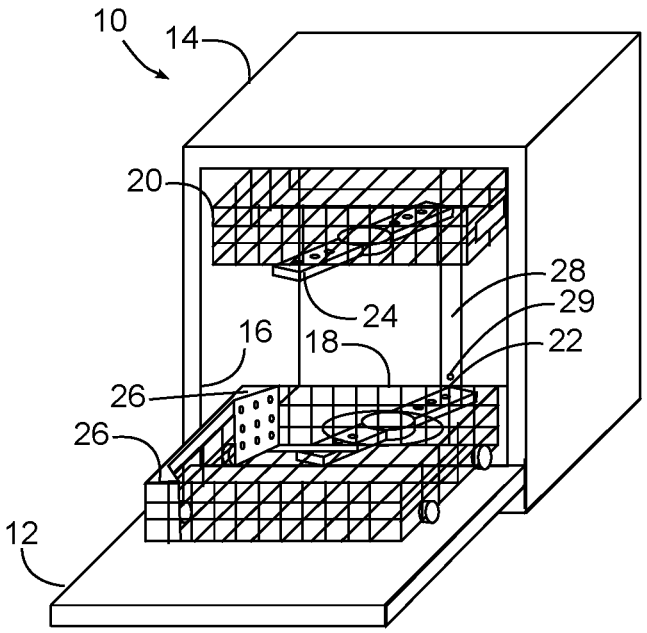
FIG. 1 is a perspective view of a dishwasher consistent with some embodiments of the invention.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers, while upper rack 20 may be supported on side rails, and each rack is movable between loading (extended) and washing (retracted) positions along a substantially horizontal direction. One or more rotating spray arms, e.g., lower spray arm 22 and upper spray arm 24, may also be provided to direct a spray of wash fluid onto utensils, e.g., upwardly into the respective rack 18, 20 under which is spray arm is disposed, and lower rack may include a pair of rack corner sprayers 26 disposed therein to provide additional sprays of wash fluid onto utensils, as will be discussed further hereinafter. Corner sprayers 26 may receive wash fluid from a supply channel 28 disposed on a rear wall of wash tub 16, e.g., through a docking port 29, as will be described in greater detail below.

Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers.

Figure 2:
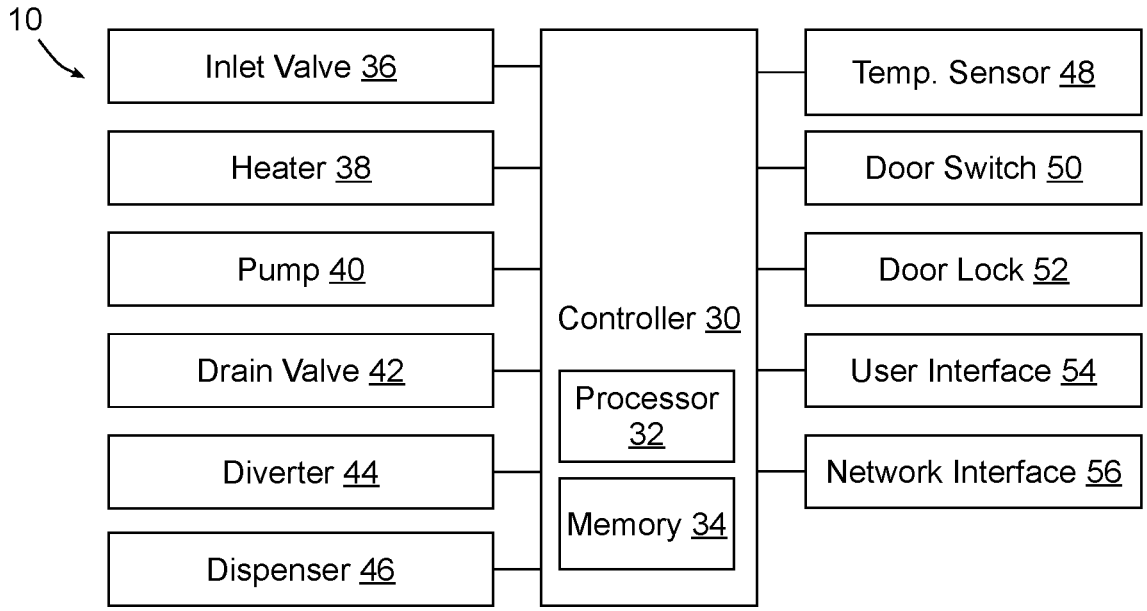
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors 32 and a memory 34 within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 36 that is coupled to a water source to introduce water into wash tub 16, which when combined with detergent, rinse agent and/or other additives, forms various fluids. Controller may also be coupled to a heater 38 that heats fluids, a pump 40 that recirculates fluid within the wash tub by pumping fluid to the wash arms and other spray devices in the dishwasher, a drain valve 42 that is coupled to a drain to direct fluids out of the dishwasher, and a diverter 44 that controls the routing of pumped fluid to different wash arms and/or other sprayers during a wash cycle. In some embodiments, a single pump 40 may be used, and drain valve 42 may be configured to direct pumped fluid either to a drain or to the diverter 44 such that pump 40 is used both to drain fluid from the dishwasher and to recirculate fluid throughout the dishwasher during a wash cycle. In other embodiments, separate pumps may be used for draining the dishwasher and recirculating fluid. Diverter 44 in some embodiments may be a passive diverter that automatically sequences between different outlets, while in some embodiments diverter 40 may be a powered diverter that is controllable to route fluid to specific outlets on demand. Generally, pump 40 may be considered to be a fluid supply in some embodiments as pump 40 supplies a pressurized source of fluid to diverter 40 for distribution to one or more spray arms and/or sprayers.

Controller 30 may also be coupled to a dispenser 46 to trigger the dispensing of detergent and/or rinse agent into the wash tube at appropriate points during a wash cycle. Additional sensors and actuators may also be used in some embodiments, including a temperature sensor 48 to determine a fluid temperature, a door switch 50 to determine when door 12 is latched, and a door lock 52 to prevent the door from being opened during a wash cycle. Moreover, controller 30 may be coupled to a user interface 54 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 56, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Dishwasher with Rack Corner Sprayers

Figure 3:
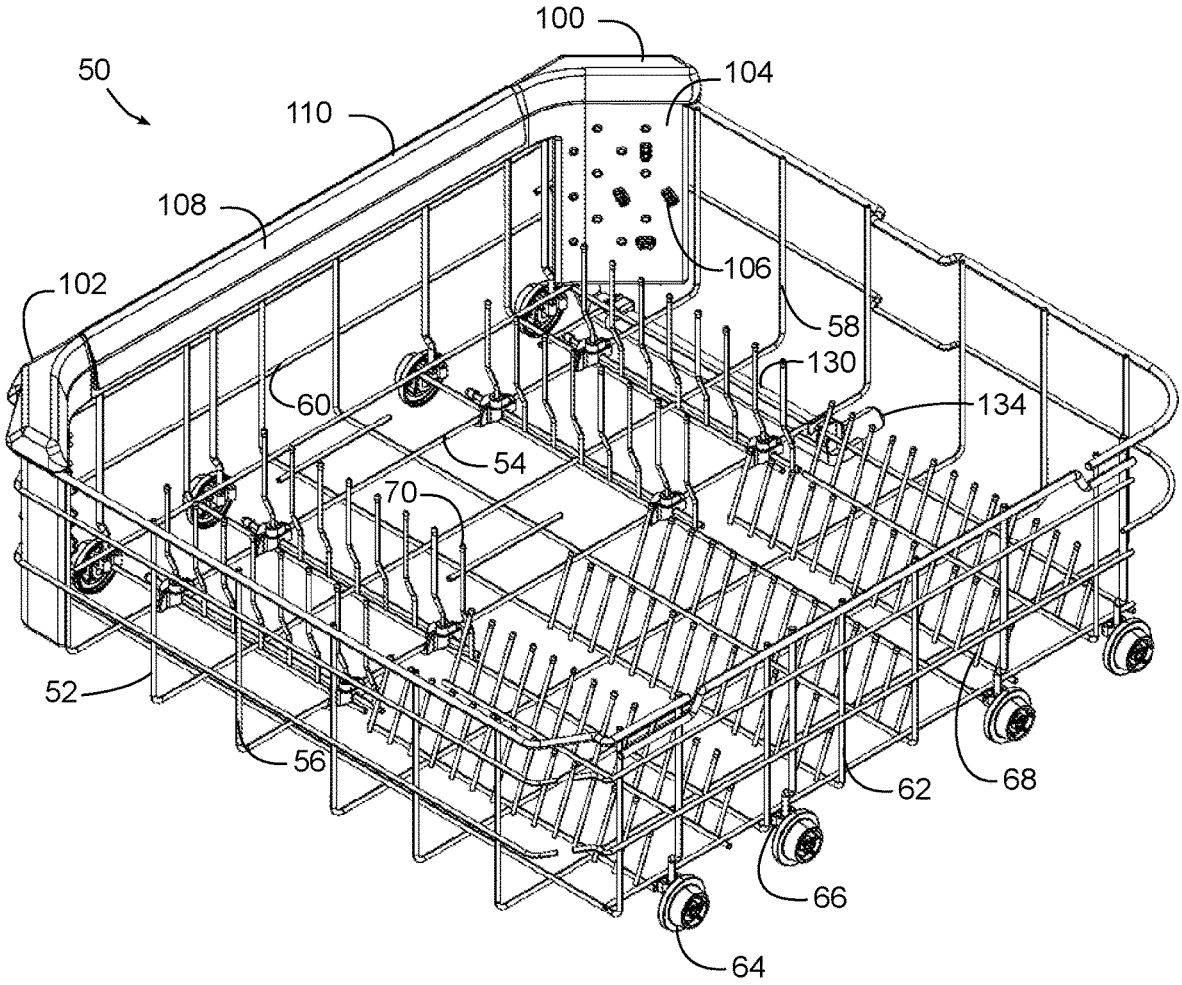
FIG. 3 is a perspective view of a rack incorporating corner sprayers consistent with some embodiments of the invention, and suitable for use in the dishwasher of FIGS. 1-2.
Figure 4:
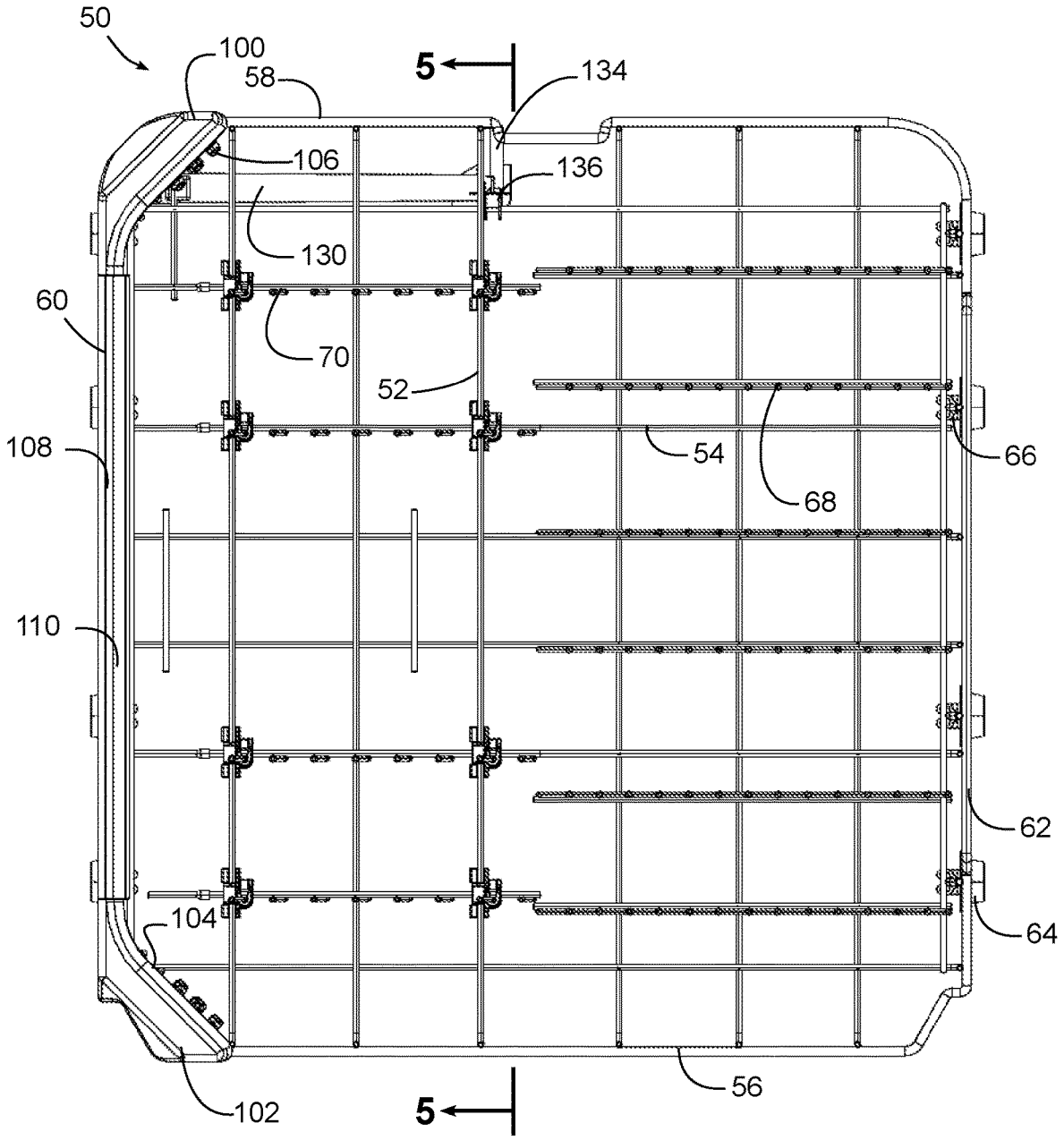
FIG. 4 is a top plan view of the rack of FIG. 3.
Figure 5:
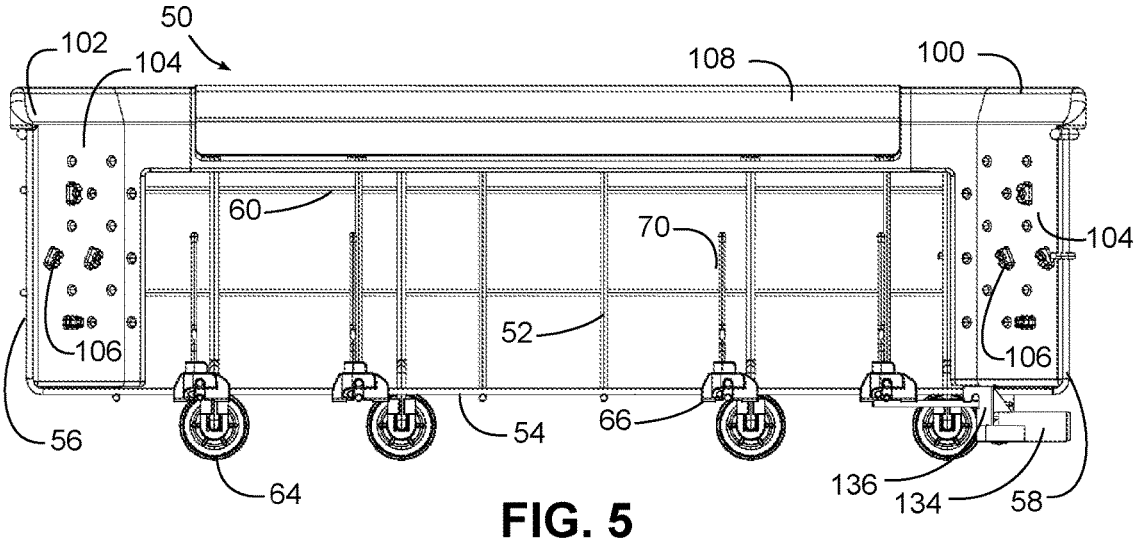
FIG. 5 is a side cross-sectional view of the rack of FIG. 3, taken along lines 5-5 of FIG. 4.

Now turning to FIGS. 3-9, in some embodiments, a dishwasher may utilize rack corner sprayers in one or more racks of a dishwasher that support utensils to be washed by the dishwasher. With reference to FIG. 3, for example, a rack 50 may be formed of coated wires 52 to define a bottom 54, front wall 56, rear wall 58, left wall 60 and right side wall 62. In the illustrated embodiment, rack 50 is a lower rack, and as such may be supported by a plurality of rollers or wheels 64 attached to the rack via associated roller mounts 66. Rack 50 also includes a plurality of tines for supporting utensils in the rack, a portion of which may be fixed tines, e.g., fixed tine 68, while another portion of which may be movable or adjustable, e.g., movable tine 70.

It will be appreciated that other rack designs may be used in other embodiments. For example, rack corner sprayers may be used in upper or middle racks, and as such, other supporting structures may be used in other embodiments. Further, racks may be formed of other materials, e.g., plastic, and may have various configurations of movable and/or fixed tines. Racks may also include other sprayers, as well as one or more containers such as a silverware basket. Therefore, the invention is not limited to the particular rack configuration illustrated in FIGS. 3-9.

Figure 10:
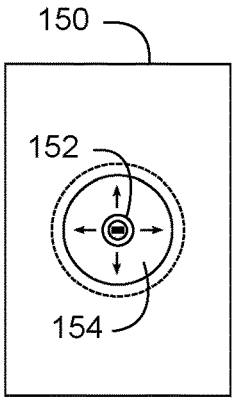
FIG. 10 is a front elevational view of another corner sprayer design consistent with the invention, and including a repositionable nozzle.

In embodiments consistent with the invention, a pair of corner sprayers 100, 102 are disposed in corners of a rack 50, and each includes a face 104 including one or more apertures or nozzles 106 disposed thereon that are configured to direct a spray of wash fluid inwardly from each of the walls defining the corner within which corner sprayer is disposed. Face 104 in the illustrated embodiment is generally oriented about 45 degrees relative to each of the walls defining the respective corner for the corner sprayer (e.g., rear wall 58 and left wall 60 for corner sprayer 100 and front wall 56 and left wall 60 for corner sprayer 102). It will be appreciated, however, that face 104 may be oriented in multiple directions in other embodiments, while in other embodiments, a face may include multiple orientations or portions, and may include various combinations of planar or curved surfaces. Nozzles 106 may be fixed in some embodiments, and in some embodiments, at least a portion of the nozzles 106 may be fluidic nozzles. Still other embodiments may include one or more rotating or oscillating nozzles supported by a corner sprayer. Moreover, in some embodiments one or more nozzles may be repositionable to control a direction of the spray of fluid, e.g., to enable a user to manually manipulate the nozzle to direct the spray of fluid towards a particular piece of dishware placed in the rack proximate a corner sprayer. FIG. 10, for example, illustrates a corner sprayer 150 including a repositionable nozzle 152 mounted on a generally spherical body 154 configured similar to a ball valve, and permitting repositioning within a range of horizontal and vertical positions.

Returning to FIGS. 3-9, corner sprayers 100, 102 are in fluid communication with one another through a fluid channel 108 that extends along the left wall 60 of rack 50. In the illustrated embodiment, fluid channel 108 runs along a top of left wall 60 of rack 50, and each of corner sprayers 100, 102 is positioned to generally extend downwardly from the fluid channel towards bottom 54 of rack 50. With specific reference to FIG. 8, in some embodiments corner sprayers 100, 102 and fluid channel 108 may form a corner spray assembly and be molded as a unitary plastic body, and in some embodiments, a cover 110, formed of plastic, metal, or another material, may also cover a top side of fluid channel 108 in some embodiments, e.g., for visual or protective purposes. For example, where corner sprayers 100, 102 and fluid channel 108 are a unitary plastic body, cover 110 may be formed of stainless steel or another corrosion-resistant metal in some embodiments consistent with the invention.

Figure 6:
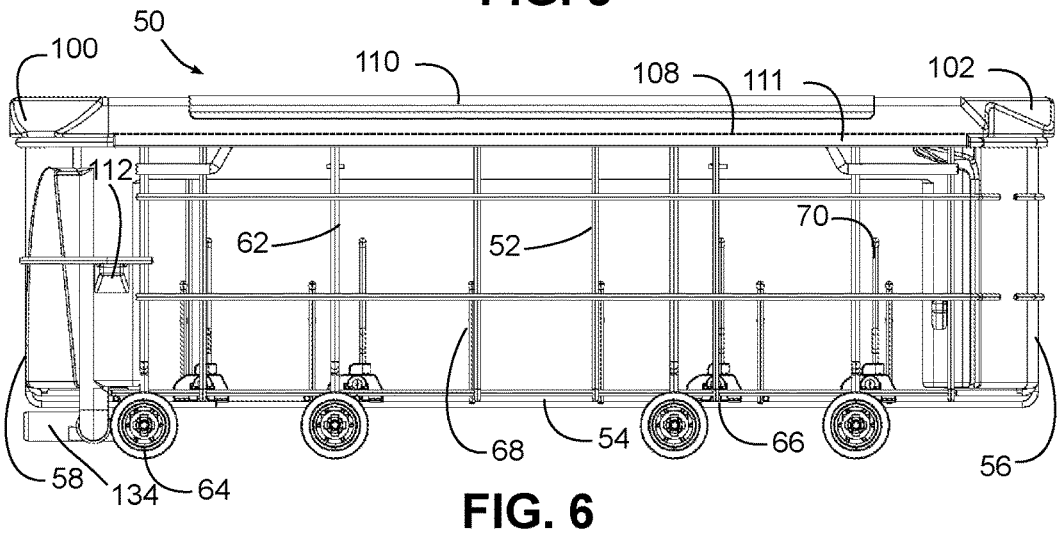
FIG. 6 is a left side elevational view of the rack of FIG. 3.
Figure 7:
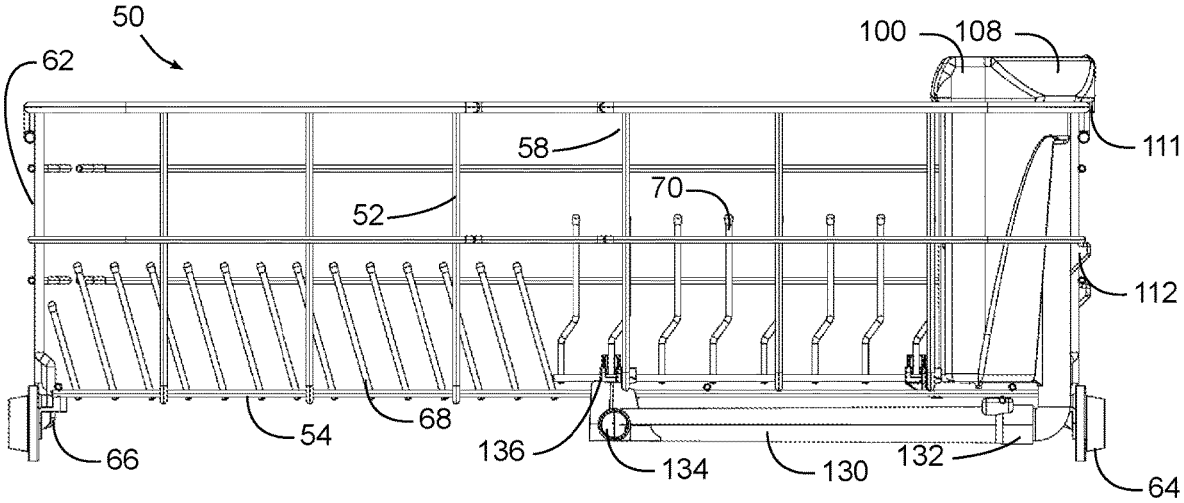
FIG. 7 is a rear elevational view of the rack of FIG. 3.
Figure 8:
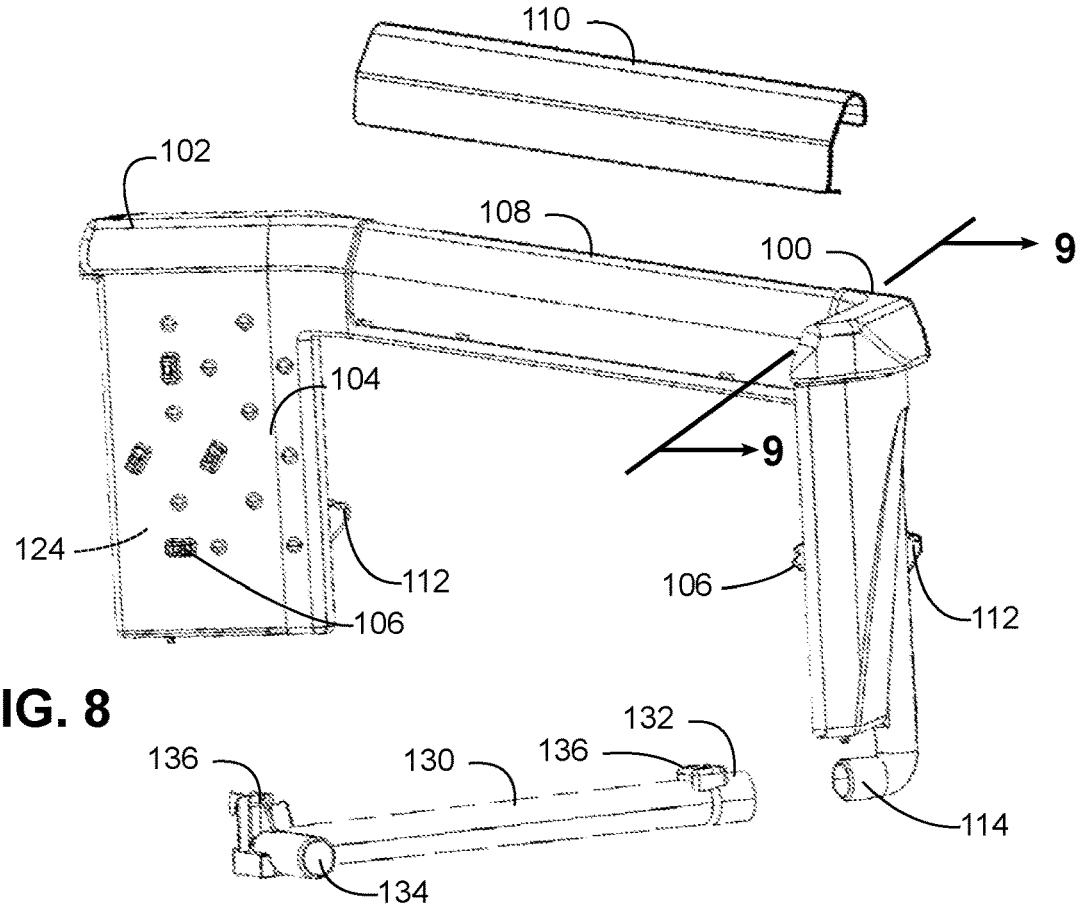
FIG. 8 is an exploded perspective view of the supply conduit, corner sprayers and cover disposed in the rack of FIG. 3.

With specific reference to FIGS. 6 and 7, corner sprayers 100, 102 and fluid channel 108 may also include a downwardly facing lip 111 on an outer edge thereof to support the unitary plastic body on the top of rack 50 (e.g., on a top coated wire of left wall 60), and one or more tabs 112 may also be molded onto each of corner sprayers 100, 102 to engage horizontally-extending coated wires on one or more of walls 56, 58 and 60. In some embodiments, tabs 112 and lip 111 may be configured to enable corner sprayers 100, 102 and/or fluid channel 108 to be removable from the rack.

Figure 9:
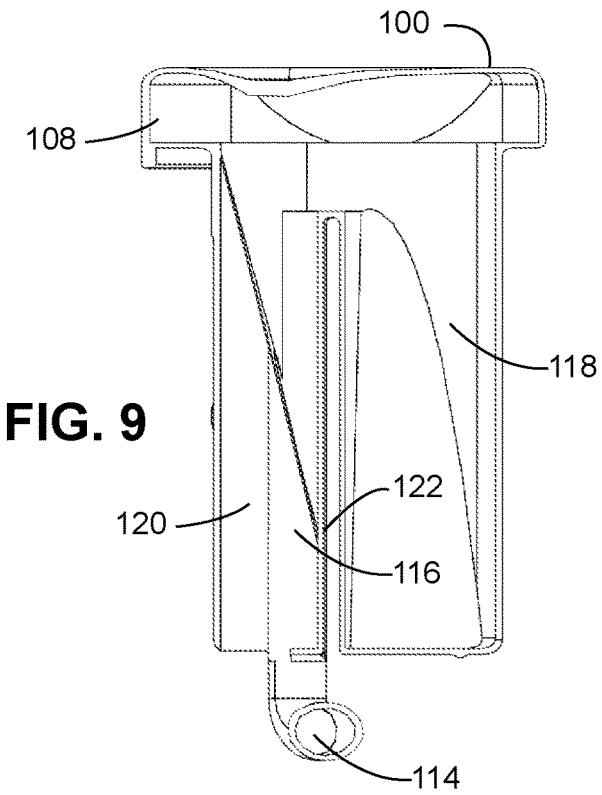
FIG. 9 is a side cross-sectional view of one of the corner sprayers of FIG. 8, taken along lines 9-9 thereof.

In addition, to supply wash fluid to corner sprayers 100, 102, an inlet port 114 is molded with corner sprayer 100, and with specific reference to FIG. 9, inlet port 114 may be disposed proximate a bottom of first corner sprayer 100 and is in fluid communication with a generally vertical conduit 116 that communicates at least a portion of the fluid from inlet port 114 to fluid channel 108 proximate the top of corner sprayer 100. Another portion of the fluid from inlet port 114 is communicated to a pair of internal cavities 118, 120 in corner sprayer 100, and a divider 122 may separate cavities 118, 120, with conduit 116 extending through divider 122. As such, inlet port 114 is in fluid communication with both fluid channel 108 and the one or more nozzles 106 of first corner sprayer 100.

Returning to FIG. 8, corner sprayer 102 may also include one or more internal cavities (e.g., internal cavity 124). It will be appreciated that each of nozzles 106, internal cavities 118, 122 and 124, inlet port 114, conduit 116, divider 122 and fluid channel 108 may be sized and configured to provide any desired spray pattern given a particular volume of fluid supplied to inlet port 114, e.g., to balance the volume of fluid provided to each of corner sprayers 100, 102, to control the volume, direction, spray pattern and/or velocity of fluid output from each nozzle 106, etc.

To supply fluid to inlet port 114, a supply conduit 130 is attached to inlet port 114, e.g., using an outlet port 132 that is sized and configured to be press fit over inlet port 114, and an inlet port 134 disposed at the opposite end of supply conduit 130 is configured to dock with a corresponding docking port (e.g., docking port 29 of supply channel 28 illustrated in FIG. 1). One or more tabs 136 may also be provided to secure supply conduit 130 to rack 50, e.g., along rear wall 58 or along bottom 54 thereof, and in some embodiments, tabs 136 may be configured to enable supply conduit 130 to be removable from the rack. Supply conduit 130 has a major longitudinal axis that extends generally transverse to left wall 60, while inlet port 134 extends generally transverse to the major longitudinal axis of supply conduit 130.

Inlet port 134 is generally positioned proximate a lateral midline of rack 50 and extends generally transverse to the major longitudinal axis of supply conduit 130, as well as generally in parallel with the direction of movement of rack 50 between loading and washing positions, such that when rack 50 is moved from the loading position to the washing position, inlet port 134 may engage a docking port on the wall of the dishwasher. Other docking configurations may be used in other embodiments, as will be appreciated by those of ordinary skill having the benefit of the instant disclosure.

Corner sprayers 100, 102 may be supplied with fluid either concurrently with one or more other sprayers in a dishwasher, e.g., one or both of spray arms 22, 24 of FIG. 1, or may be supplied with fluid separately, e.g., using various diverter and/or valve designs that will be appreciated by those of ordinary skill having the benefit of the instant disclosure. In some embodiments, a diverter, e.g., diverter 44 of FIG. 2, may be in fluid communication between a fluid supply (e.g., pump 40), a spray arm (e.g., spray arm 22) and inlet port 114. In some instances, the diverter may be configured to convey fluid concurrently from the fluid supply to the spray arm and the inlet port, while in other instances, the diverter may be configured to convey fluid separately from the fluid supply to the spray arm and the inlet port.

Corner sprayers 100, 102 may also be used at all times during a wash cycle in some embodiments, while in other embodiments, corner sprayers 100, 102 may only be active during certain portions of a wash cycle and/or only active during certain wash cycles or based upon certain wash settings. Further, it may be desirable in some embodiments to include one or more manually-actuatable valves on a corner sprayer 100, 102, e.g., to vary the flow rate output by one or more of corner sprayers 100, 102, or to selectively disable one or more of corner sprayers 100, 102. In one example embodiment, a manually-actuated diverter valve may be disposed on one of corner sprayers 100, 102 to select between three modes: corner sprayer 100 only, corner sprayer 102 only, and both of corner sprayers 100, 102 together.

In operation, corner sprayers 100, 102 may be used in some embodiments to spray wash fluid generally in a horizontal direction, which may be well suited for washing utensils such as plates, bowls, trays, pots, pans, etc. having larger surface areas that are oriented generally vertically when placed into rack 50. Corner sprayers 100, 102, being disposed in the corners of a rack and directed inwardly from the corners, may also be used to direct fluid against utensils with a reduced likelihood of directing fluid against a wall of a wash tub, which could otherwise generate noise during a wash cycle.

It will also be appreciated that while two corner sprayers 100, 102 are illustrated as being disposed within the left rear and left front corners of rack 50, the invention is not so limited. Corner sprayers 100, 102 could alternatively be disposed in right rear and right front corners in other embodiments. Moreover, while fluid channel 108 is illustrated as extending along a top of left wall 60, in other embodiments fluid channel 108 may run along an inner and/or outer face of a rack wall and/or along the bottom of the rack, so the invention is not limited to a top-extending fluid channel.

Various additional modifications may be made to the illustrated embodiments consistent with the invention. Therefore, the invention lies in the claims hereinafter appended.

What is claimed is:

1. A dishwasher, comprising:

a wash tub;

a rack disposed in the wash tub and configured to support a plurality of utensils to be washed, the rack including a bottom, a rear wall, a front wall, a first side wall and a second side wall;

a pump configured to recirculate fluid within the wash tub;

a first corner sprayer disposed in a first corner of the rack defined by the rear wall and the first side wall, the first corner sprayer including at least one nozzle configured to direct a spray of fluid inwardly from each of the rear wall and the first side wall;

a second corner sprayer disposed in a second corner of the rack defined by the front wall and the first side wall, the second corner sprayer including at least one nozzle configured to direct a spray of fluid inwardly from each of the front wall and the first side wall;

a fluid channel extending along the first side wall of the rack and in fluid communication with each of the first and second corner sprayers; and an inlet port coupled to the first corner sprayer and in fluid communication with the fluid channel and the at least one nozzle of the first corner sprayer;

wherein the fluid channel is coupled to and extending along a top of the first side wall of the rack and with at least a portion of the fluid channel extending above a top edge of the first side wall of the rack, and wherein the first and second corner sprayers are positioned to extend downwardly from the fluid channel towards the bottom of the rack.

2. The dishwasher of claim 1, wherein the inlet port is disposed proximate a bottom of the first corner sprayer and the fluid channel is coupled to the first corner sprayer proximate a top of the first corner sprayer.

3. The dishwasher of claim 2, wherein the first corner sprayer includes a generally vertical conduit extending between the inlet port and the fluid channel.

4. The dishwasher of claim 3, wherein the first corner sprayer further includes a divider through which the generally vertical conduit projects.

5. The dishwasher of claim 1, wherein the first and second corner sprayers, the fluid channel and the inlet port are formed of a unitary plastic body.

6. The dishwasher of claim 5, further comprising a supply conduit having an outlet port coupled to the inlet port and having a major longitudinal axis extending generally transverse to the first side wall.

7. The dishwasher of claim 6, wherein the supply conduit further includes an inlet port extending generally transverse to the major longitudinal axis of the supply conduit and configured to dock with a docking port disposed on a rear wall of the wash tub.

8. The dishwasher of claim 7, wherein the supply conduit includes at least one tab configured to secure the supply conduit to the rack.

9. The dishwasher of claim 1, wherein the rack includes a plurality of coated wires, wherein each of the first and second corner sprayers includes at least one tab configured to engage a coated wire of the rack, and wherein the first and second corner sprayers are removable from the rack.

10. The dishwasher of claim 9, wherein the fluid channel includes a downwardly-facing lip disposed on an outer edge thereof to support the fluid channel on a top coated wire of the first side wall.

11. The dishwasher of claim 1, wherein each of the first and second corner sprayers includes a face that extends about 45 degrees from the first side wall, wherein the at least one nozzle of each of the first and second corner sprayers is disposed on the face of the respective first or second corner sprayer.

12. The dishwasher of claim 1, wherein the nozzle of at least one of the first and second corner sprayers is repositionable to control a direction of the spray of fluid.

13. The dishwasher of claim 1, wherein the first side wall is a left wall of the rack.

14. The dishwasher of claim 1, further comprising a cover extending along a top side of the fluid channel.

15. The dishwasher of claim 14, wherein the fluid channel is formed of plastic and the cover is formed of metal.

16. The dishwasher of claim 1, further comprising:

a spray arm disposed below the rack and configured to direct fluid upwardly into the rack; and a diverter in fluid communication between a fluid supply, the spray arm and the inlet port.

17. The dishwasher of claim 16, wherein the diverter is configured to convey fluid concurrently from the fluid supply to the spray arm and the inlet port.

18. The dishwasher of claim 16, wherein the diverter is configured to convey fluid separately from the fluid supply to the spray arm and the inlet port.

19. A dishwasher rack, comprising:

a bottom, a rear wall, a front wall, a first side wall and a second side wall; and a corner spray assembly mounted to the first side wall and including a unitary body defining a first corner sprayer, a second corner sprayer, a fluid channel and an inlet port;

wherein the first corner sprayer is disposed in a first corner of the rack defined by the rear wall and the first side wall and includes at least one nozzle configured to direct a spray of fluid inwardly from each of the rear wall and the first side wall;

wherein the second corner sprayer is disposed in a second corner of the rack defined by the front wall and the first side wall and includes at least one nozzle configured to direct a spray of fluid inwardly from each of the front wall and the first side wall;

wherein the fluid channel extends along a top of the first side wall of the rack and is in fluid communication with each of the first and second corner sprayers;

wherein the fluid channel is coupled to the first corner sprayer proximate a top of the first corner sprayer and is coupled to the second corner sprayer proximate a top of the second corner sprayer;

wherein the first and second corner sprayers extend downwardly from the fluid channel towards the bottom of the dishwasher rack;

wherein the inlet port is coupled to the first corner sprayer proximate a bottom of the first corner sprayer and is in fluid communication with the fluid channel and the at least one nozzle of the first corner sprayer; and wherein the first corner sprayer includes a generally vertical conduit extending between the inlet port and the fluid channel.

20. The dishwasher rack of claim 19, wherein at least a portion of the fluid channel extends above a top edge of the first side wall of the rack.

* * * * *